US005503228A

United States Patent [19]

Anderson

[11] Patent Number: 5,503,228

[45] Date of Patent: Apr. 2, 1996

[54] JAR APPARATUS AND METHOD OF JARRING

[76] Inventor: Edwin A. Anderson, 1104 Chimney Rock Rd., Houston, Tex. 77056-2002

[21] Appl. No.: 349,253

[22] Filed: Dec. 5, 1994

[51] Int. Cl.[6] ..... E21B 31/113

[52] U.S. Cl. ..... 166/301; 166/178; 175/297; 175/299

[58] Field of Search ..... 175/297, 299; 166/178, 301

[56] References Cited

U.S. PATENT DOCUMENTS

| | | | |
|---|---|---|---|
| 2,265,431 | 12/1941 | Kerr . | |
| 2,733,045 | 1/1956 | Burns, Jr. | 175/297 |
| 2,801,078 | 7/1957 | Medders et al. . | |
| 2,896,917 | 7/1959 | McGarraham | 175/297 |
| 3,539,025 | 11/1970 | Sutliff et al. | 175/297 |
| 3,627,356 | 12/1971 | Anderson | 285/118 |
| 3,651,867 | 3/1972 | Baumstimler | 166/99 |
| 4,109,736 | 8/1978 | Webb et al. | 175/297 |
| 4,462,471 | 7/1984 | Hipp | 175/296 |
| 4,545,444 | 10/1985 | Webb et al. | 175/296 |
| 4,646,830 | 3/1987 | Templeton | 166/178 |
| 5,029,642 | 7/1991 | Crawford | 166/178 X |
| 5,411,107 | 5/1995 | Hailey et al. | 175/296 |

OTHER PUBLICATIONS

Brochure: "Hydra–Jar: Double–Acting Hydraulic Drilling or Fishing Jar." Houston Engineers, Inc., Houston, Texas, 1991.

*Primary Examiner*—Hoang C. Dang
*Attorney, Agent, or Firm*—Kenneth L. Nash

[57] ABSTRACT

A jar apparatus (jar) 10 includes a plurality of pistons 16 that are secured together to form a piston assembly 23. Piston assembly 23 is movable axially in response to an actuating pressure differential between the jar bore 17 and the portion of borehole 19 that surrounds jar 10. Biasing spring 28 biases piston assembly 23 to return to a closed position when the actuating pressure differential is reduced by a predetermined amount. Piston assembly 23 forces a hammer member 32 and a movable anvil portion 30A axially to cock the jar in response to the applied actuating pressure differential. When the pressure differential is reduced, biasing spring 28 moves movable anvil portion 30A against anvil support portion 30B. Detent assembly 47 temporarily limits the velocity of hammer member 32 towards movable anvil portion 30A after the pressure differential is reduced. Compressed nitrogen 64 in nitrogen chamber 31 biases hammer member towards movable anvil portion 30A to deliver a jar impact.

48 Claims, 7 Drawing Sheets

JAR APPARATUS AND METHOD OF JARRING

BACKGROUND OF THE INVENTION

1. Field of the Invention

The present invention relates generally to jar assemblies and, more particularly, to a hydraulic jar apparatus (jarring tool) and method that operates to effect an axially directed jar impact without the requirement to reciprocate the wellbore string, e.g., the pipe or coiled tubing to which the jarring tool is attached.

2. Description of the Background

Coiled tubing is used in almost every area of oil and gas well operations from drilling operations to workovers. Because of the economy of operation and the convenience of moving a coiled tubing unit as compared to moving a drilling or workover rig, coiled tubing technology is increasingly used to replace rig operations in many areas, especially in remote areas. Coiled tubing may also be used for many specialized purposes such as gas injection or fishing operations.

During coiled tubing operations, various downhole tools are utilized, including jars for removing objects that may become stuck within the wellbore. For instance, expensive bottom hole assemblies including measurement-while-drilling (MWD) tools, bits, drill collars, stabilizers, jar sections, and the like, frequently become stuck in the wellbore.

Presently available jar apparatuses, including hydraulic jar apparatuses, require that the string be reciprocated to effect a jar impact. When operating a jar apparatus by reciprocating coiled tubing, the coiled tubing experiences bending cycles that introduce plastic strain and fatigue as the tubing is transferred from the storage reel to the wellbore. Although the surface components of the coiled tubing units, such as the injector head, tubing guide, and service reel, may be designed to extend the life of the coiled tubing, fatigue failure eventually occurs due to transfer of the coiled tubing from the storage reel to the wellbore. Fatigue failure occurs more rapidly if repeated high strains are imposed in combination with internal pressure within the coiled tubing. Fatigue failure may also be exacerbated by corrosion that may occur due to corrosive fluids, hydrogen sulfide, carbonic acid, saturated salt solutions, and the like. Additionally, coiled tubing strain may occur due to borehole geometry and deviation, pipe and tool weight, wellbore pressure, and frictional effects of tubing rubbing against casing or openhole.

In many instances, to effect recovery of a stuck tool, it is necessary to actuate the jar by reciprocating the pipe string many times. While coiled tubing is typically designed to be safely reciprocated thousands of times without failure, any failure of the coiled tubing that does occur is likely to be catastrophic. Coiled tubing failure can lead to costly loss of equipment and loss of the well, and/or cause human injury.

Because of the danger of coiled tubing failure, coiled tubing operators have a standard operating procedure of permitting only a certain number of reciprocations over a particular region of the tubing before the tubing is pulled from the wellbore. In fact, some experts recommend permitting only as few as ten reciprocations, depending on the conditions of the operation, before the tubing is pulled from the wellbore. The operator then cuts off a portion, generally about fifty or more feet, of the bottom section. The tubing is then run back into the well to continue operations with a relatively new section of coiled tubing positioned in the particular region where higher stress occurs. This procedure takes considerable time and must be repeated as necessary thereby greatly increasing the cost of the operation.

Both coiled tubing units and drilling rigs are used to drill horizontally extended reach wells, both onshore and offshore, that are now common operations all over the world. The bottom hole assembly (BHA) employed in such drilling operations may consist of a downhole motor, several nonmagnetic drill collars, an MWD tool, and other equipment. A drilling jar is usually run in the top section of this assembly. During the drilling operation, it is not uncommon for the BHA to become stuck, as discussed hereinbefore. Repeated jarring may not free the BHA and, in fact, the jar itself may become stuck or inoperable. It would be desirable to be able to continue jarring regardless of whether the BHA is stuck. It is also desirable to avoid reciprocating the coiled tubing during the jarring to avoid stress applied thereto as discussed hereinbefore. As well, coiled tubing may be used in fishing/workover operations to jar a stuck fish (downhole assembly of some type) from a well bore either in open hole or cased hole.

With standard pipe strings comprised of separately threaded pipes operable with a drilling or workover rig, it may be desirable to have the option to actuate a jar that is in a part of the pipe string below the stuck point or region. A jar apparatus positioned below the typical stuck point cannot be actuated because the pipe below the stuck point cannot be reciprocated.

In some cases, it would be desirable to position a jar in a portion of the bottom hole assembly that is more likely to become stuck, if the operator can be fairly certain it will be possible to actuate the jar regardless of whether the pipe can be reciprocated. In some cases, more than one jar is included in the pipe string, and it may be desirable to have the option to conveniently control each jar independently.

Another problem sometimes associated with the jar apparatus is the need to maintain a flow path therethrough. Because the jar apparatus typically includes relatively heavy and/or thick, axially movable bodies capable of withstanding large impacts, the provision of a flow path through the jar apparatus is an engineering problem for each jar design and especially for a hydraulic jar that has limited internal surface area for applying hydraulic pressure. It is desirable that the internal diameter of the flow path be as large as possible to allow passage of various wireline tools. At a minimum, the internal diameter should allow passage of a drop ball or other dropped member, to actuate release tools that are provided below the jar, such as a hydraulic disconnect.

Furthermore, it is desirable that a jar for use with coiled tubing be of relatively short length so that it can be accommodated within the length of a lubricator used to contain wellbore pressure. The jar design of the present invention allows adaptation to a short length if necessary but also allows a longer relative length of the jar if no length restrictions are desired. As well, it is desirable that the jar apparatus be easily transportable.

U.S. Pat. No. 4,545,444 and U.S. Pat. No. 3,627,356, which patents also designate the present inventor, are directed to a Jar Mechanism Energizer and a Directional Drilling Apparatus with Retrievable Limiting Device, respectively, and are each incorporated herein by reference.

Consequently, there remains a need for a jarring tool and assembly that offers dependable operation whether contained in the BHA below the stuck point or not, and without the need to reciprocate the string. Ideally, the jarring assembly should be relatively short and easy to transport. Those skilled in the art have long sought and will appreciate that the present invention provides solutions to these and other problems.

SUMMARY OF THE INVENTION

The present invention discloses a jar assembly for incorporation within a pipe string used within a borehole. The jar assembly is responsive to a pump operable for pumping fluid through the pipe string. The jar assembly includes a tubular body (of one or more sections) with connectors on each end for securing the jar within the pipe string. An anvil member is disposed within the tubular body and is supported for jar impact by an anvil support also carried by the tubular body. A hammer member is axially movable between a first position distal the anvil support and a second position proximal the anvil support. A portion of the anvil member is preferably movable with the hammer member and is separable therefrom prior to delivering the jar impact. The hammer member is operable for impacting the anvil member to deliver the axially directed jar impact. A first biasing assembly is operable for biasing the hammer member axially in the direction of the anvil member. A pressure-responsive control assembly is responsive to a first fluid pressure within the string produced by the pump for urging the hammer member toward the first position. The pressure-responsive control assembly is also responsive to a second fluid pressure, typically a decreased fluid pressure, within the string produced by the pump for releasing the hammer member from the first position for rapid movement toward the anvil in response to the first biasing assembly.

The method of the present invention provides for delivering a jar impact to a component of a well string such as a pipe string or coiled tubing. The string includes therein the jar assembly that comprises a hammer and an anvil for producing the jar impact. The well string has a well string bore. The method comprises cocking the hammer by creating a first pressure differential, usually by pumping with a pump in the wellbore string, for moving the hammer to a first cocked position. In this manner, a void or vacuum is also created between the bottom of the anvil and top of the hammer. The method further includes releasing the hammer from the cocked position by controlling the pressure in the wellbore string to produce a second differential pressure to thereby allow the hammer to move substantially axially toward and strike against the anvil to deliver the jar impact.

It is therefore an object of the present invention to provide an improved jar apparatus or jarring tool.

It is another object of the present invention to provide a jar apparatus that does not require reciprocation of the wellbore string in order to effect a jar impact.

It is yet another object of the present invention to provide a jar apparatus that does not require reciprocation of the pipe string and that may produce either an up-jar impact or a down-jar impact depending on its orientation within the pipe string.

It is yet another object of the present invention to produce a jar apparatus that may be combined with one or more additional jar apparatuses to produce multiple sequential up-jar, down-jar, or various up/down combination jar impacts as may be desired.

It is yet another object of the present invention to produce a jar apparatus that may be used with coiled tubing to lower the cost and time of fishing operations. The coiled tubing may be used to jar the downhole fish without the need to reciprocate the tubing.

A feature of the apparatus of the present invention is a flow path through the jar apparatus with an adequate inside diameter and smooth bore wall surfaces to allow a drop ball to pass through in order to actuate a release tool that is below the jar apparatus, such as a hydraulic disconnect.

Another feature of the present invention is the fact that the jar apparatus has a relatively short length such that the jar apparatus is shorter than a lubricator and with coiled tubing. However, while the design of the present invention allows for a relatively short length, it also allows for a longer length jar apparatus where lubricator length restrictions are not necessary.

Another feature of the present invention is a gas, e.g., nitrogen, chamber in which the gas is stored at a desired pressure so as to accelerate a hammer to strike an anvil at a desired impact without the need to reciprocate the jar apparatus by moving the wellbore string.

An advantage of the jar apparatus of the present invention is that it is easily transportable because the jar apparatus is relatively short.

Another advantage of the gas apparatus of the present invention is that if it is included in a BHA that sticks, the rig pump can be used to actuate the jar apparatus to effect a jar impact in the BHA to assist in freeing the stuck BHA.

These and other objects, features, and advantages of the present invention will become apparent from the drawings, the descriptions given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Figure 1:
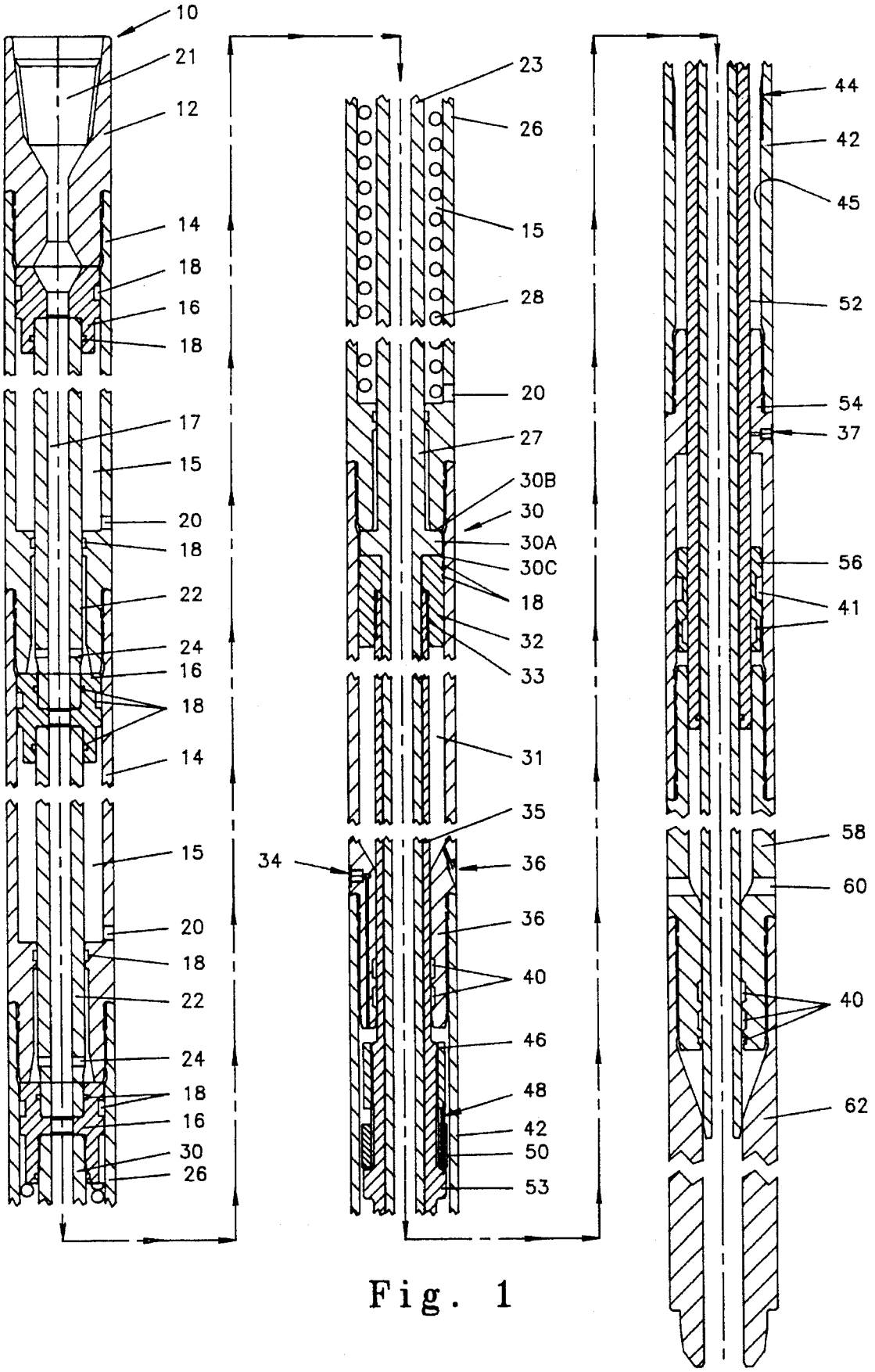
FIG. 1 is an elevational view, in section, of a jar apparatus in accord with the present invention shown in the closed position.
Figure 2:
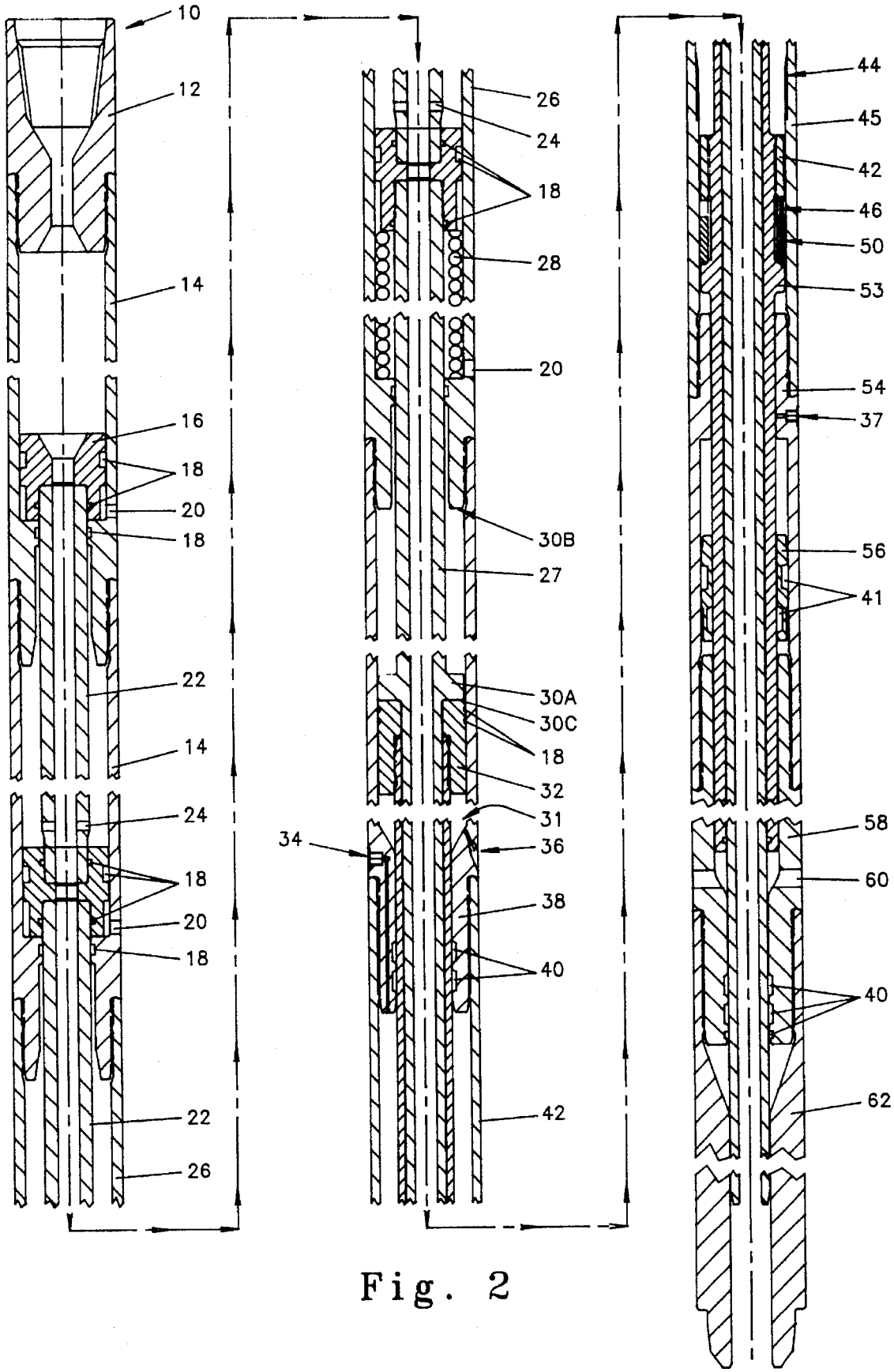
FIG. 2 is an elevational view, in section, of the jar apparatus of FIG. 1 shown with the jar hammer in a cocked position.
Figure 3:
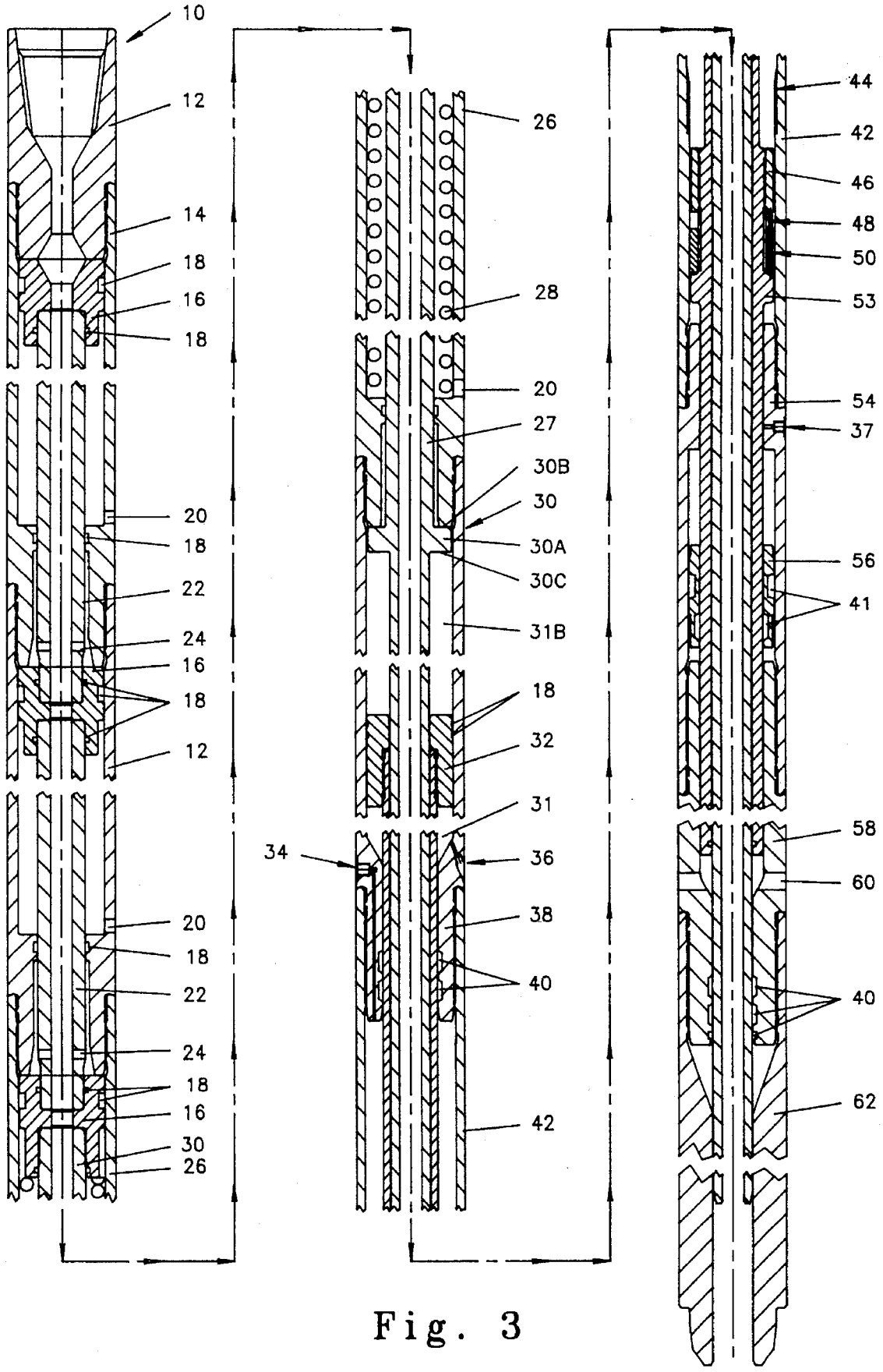
FIG. 3 is an elevational view, in section, of the jar apparatus of FIG. 1 shown after the jar hammer is cocked and as it is temporarily delayed prior to striking the anvil.

With reference now to the drawings, and more particularly to FIGS. 1–3, the general construction of a jar apparatus (jar) 10 in accord with the present invention is illustrated as a tubular body comprised of tubular sections including top sub 12, one or more piston cylinder subs 14, spring cylinder sub 26, compression cylinder 38, detent cylinder 42, neutralizer cylinder 58, and lower connector sub 62.

Figure 10:
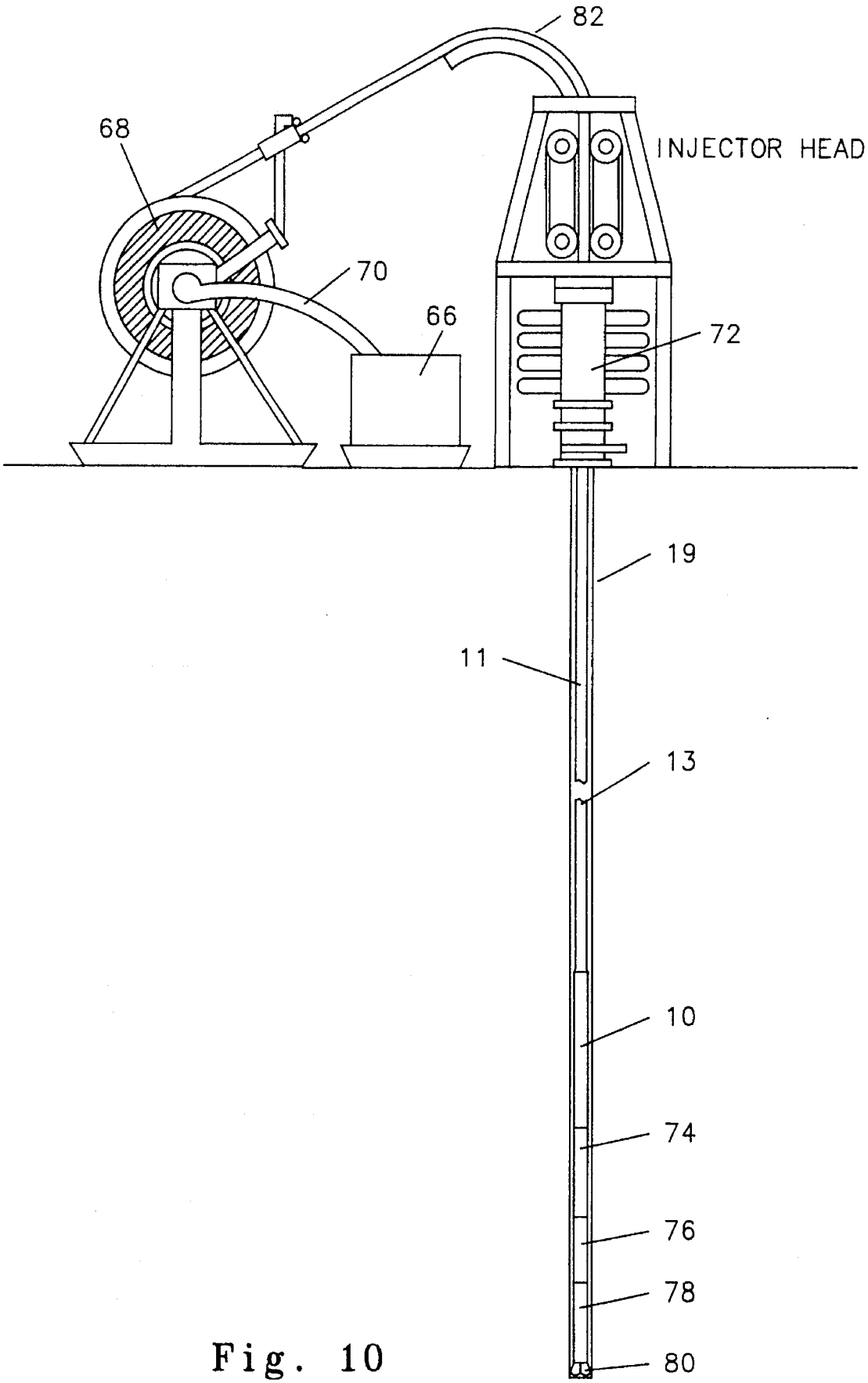
FIG. 10 is a diagrammatic view illustrating a coiled tubing unit for operating a bottom hole assembly including a jar apparatus in accord with the present invention.
Figure 11:
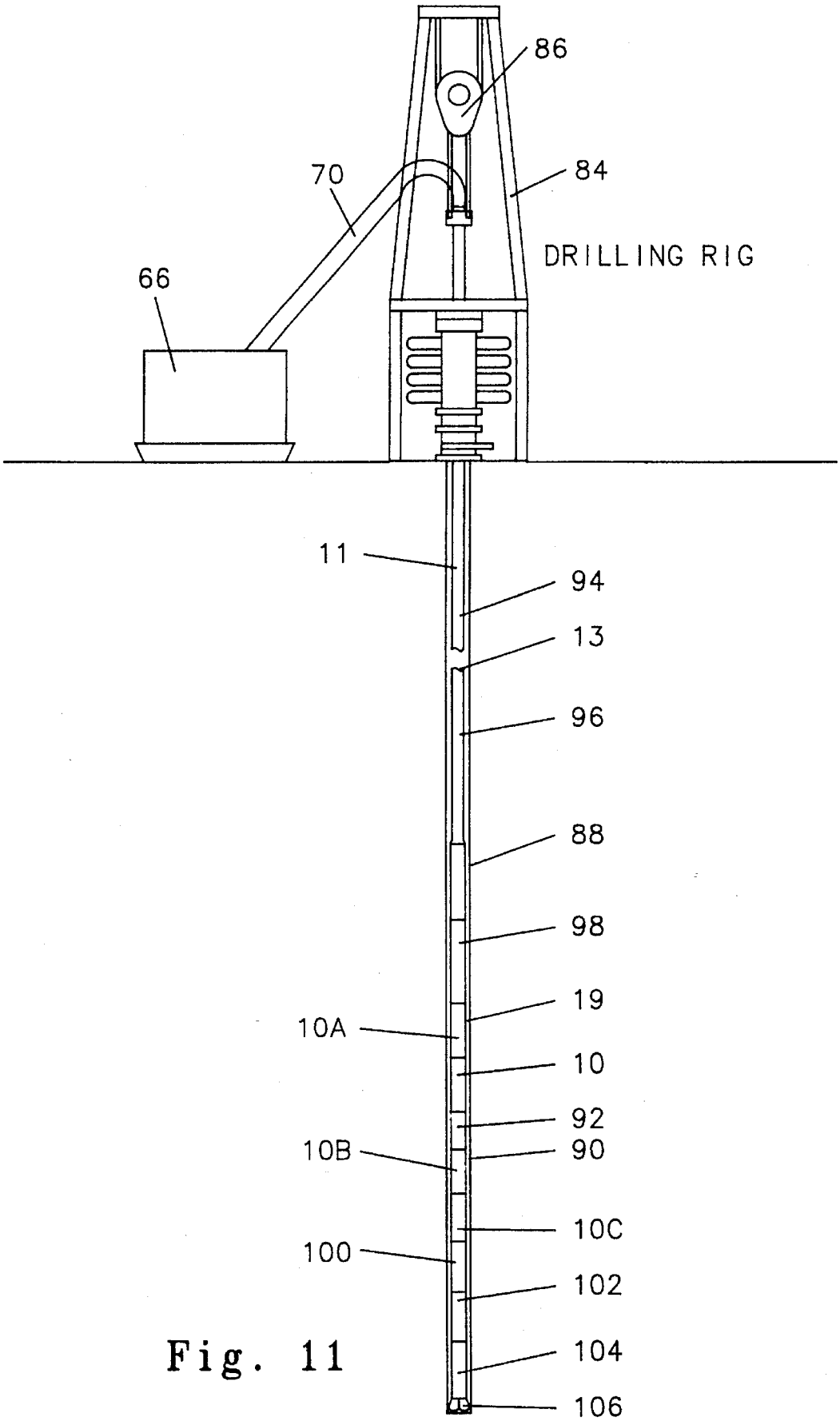
FIG. 11 is a diagrammatic view illustrating a drilling or workover rig for operating a bottom hole assembly including a jar apparatus in accord with the present invention.

At the top of jar 10, top sub 12 defines an internally threaded connection that may be used to threadably interconnect jar 10 within a wellbore string. The wellbore string may be substantially comprised of either continuous coiled tubing as shown in FIG. 10 or FIG. 11, or non-continuous/individual threaded pipes. Top sub 12 also defines therein jar bore 17 that communicates with internal bore 13 of string 11. Jar bore 17 extends through the length of a tubular body, described hereafter in detail, of jar 10 for communication with other wellbore string elements, such as a hydraulic disconnect sub, below jar 10.

It should be noted that to the extent that directions are used herein, such as "upward," "downward," "below," "above," "top," "bottom," and the like, it will be understood they refer to the drawings or to possible orientations within the borehole for ease of understanding the invention and should not be construed in any manner to limit the invention or operation of the invention. Those skilled in the art will understand that actual tool orientations during use or transport are variable. For instance, as discussed hereinafter, the jar 10 of the present invention may be oriented in the wellbore string either as shown in the drawings or inverted from the drawings. Thus, jar 10 produces either an "upwardly" directed jar impact or a "downwardly" directed jar impact as desired, depending on its orientation in the wellbore string.

With reference again to jar 10 shown in FIGS. 1–3, top sub 12 is preferably threadably secured to piston cylinder sub 14. In the presently preferred embodiment, a plurality of piston cylinder subs 14 each define therein a respective piston cylinder 15 in which a respective piston 16 reciprocates. Pistons 16 are secured together with piston mandrels 22 to form a piston assembly 23 that moves in an axial direction with respect to axis 21, axis 21 being substantially parallel or concentric with the axis of string 11 at least in the region of jar 10.

The use of tandem pistons 16 in the present invention provides a substantial force in response to a differential pressure that may be controlled from the surface and is applied between the fluid pressure in jar bore 17 and the hydrostatic pressure in the portion of wellbore 19 surrounding jar 10 (see FIG. 10 or FIG. 11). Selectively using multiple, replaceable pistons 16, the desired axial force may be obtained to cock jar 10, as discussed hereinafter, while still maintaining a desired O.D. of jar 10, allowing for a desired I.D. of jar bore 17, and also providing for a desired overall length of jar 10 for a desired application to produce the necessary amount of axial force can be calculated from the piston surface areas, estimated hydrostatic pressure, and related factors. From the drawings, it will be noted that additional piston cylinder subs 14 with associated pistons 16 and piston mandrels 22 may be readily added or subtracted as desired for this purpose.

Except for the top side of the top piston 16, the top sides of pistons 16 are connected to jar bore 17 pressure via ports 24 that communicate with jar bore 17. Wellbore 19 pressure is present on the bottom sides of pistons 16 through ports 20 that communicate between piston cylinders 15 and wellbore 19 pressure surrounding jar 10.

O-rings 18 are used to seal pistons 16 and piston mandrels 22 to thereby isolate jar bore 17 pressure from wellbore 19 pressure. Thus, with jar bore 17 pressure and wellbore 19 pressure isolated from each other, pistons 16 move axially in response to the differential pressure therebetween. Because jar bore 17 is in communication with bore 13, it may also be said that pistons 16 effectively react to fluid pressure in bore 13, which fluid pressure is readily controlled with a surface mud pump.

The lowermost piston cylinder 14 threadably connects to spring cylinder 26, as indicated in the drawings. Spring cylinder 26 provides a piston cylinder 15 but also contains therein compression spring 28 that biases piston assembly 23 towards top sub 12 in an upwardly direction, as indicated in the drawings.

In the presently preferred embodiment, compression spring 28 acts on the bottommost piston 16 to bias piston assembly 23, as indicated in FIGS. 1–6. Although compression spring 28 could be mounted elsewhere along piston assembly 23 for this purpose, compression spring 28 and spring cylinder 26 are preferably connected to piston cylinders 14 on the side opposite of piston cylinders 14 with respect to top sub 12.

Compression spring 28 encircles compression mandrel 27 that extends downwardly through the bottom of spring cylinder 26. Anvil assembly 30 includes a thickened, flange-like, movable anvil portion 30A provided on compression mandrel 27 having a striking surface 30C. Anvil assembly 30 also includes, on the side opposite the striking surface 30C of anvil member 30A, an anvil member neck support portion 30B of spring cylinder 26 to support movable anvil portion 30A. Each piston 16 is also supported by a neck portion of a related piston cylinder sub 14 to provide support for movable anvil portion 30A. Thus, anvil assembly 30 is directly braced for jar impact from hammer 32 by support portions in jar 10 within top sub 12, piston cylinder subs 14, spring cylinder 26, and compression cylinder 38. While movable anvil portion 30A is axially movable in the presently preferred embodiment, it could be also designed to be affixed to the tubular body of jar 10 with an anvil support portion 30B.

Hammer 32 reciprocates within compression cylinder 38 and is moved to a cocked position by contact with movable anvil portion 30A in the presently preferred embodiment. Hammer 32 is provided with external O-rings 18 and internal hammer mandrel seals 33 to seal pressurized nitrogen 64 within nitrogen chamber 31 of compression cylinder 38. Pressurized nitrogen 64 is used in nitrogen chamber 31 in the presently preferred embodiment for biasing hammer 32 axially in the direction of anvil assembly 30, including movable anvil portion 30A, fixed anvil support portion 30B, and striking surface 30C. Fill port 36 is provided to insert nitrogen 64 into compression cylinder 38 at a predetermined pressure as discussed hereinafter. Packing seals 40 seal around axially movable hammer mandrel 35.

As those skilled in the art will appreciate, other inert gases besides nitrogen could be used with the caveat that nonexplosive gases are best suited for this purpose to avoid possible malfunction, dangerous conditions, or other damage. Pressures in nitrogen chamber 31 may become quite high and may typically be above 15,000 psi during operation, as discussed hereinafter. While other compressible biasing means may conceivably be used, a compressed inert gas such as nitrogen is preferred and has numerous operational advantages.

Detent cylinder 42 is secured to compression cylinder 38 and is filled with a substantially noncompressible fluid, such as oil. Packing seals 40 substantially prevent oil or nitrogen 64 leakage between detent cylinder 42 and compression cylinder 38. Detent cylinder 42 is filled with oil via oil fill port 37 and port 34. Packing seals 41, disposed internally and externally of neutralizer piston 56, seal the end of detent cylinder 42 opposite from compression cylinder 38.

Detent assembly 47, shown and discussed hereinafter in greater detail with respect to FIGS. 7–9, acts as a piston to reciprocate within detent cylinder 42 to thereby delay acceleration of hammer 32 towards striking surface 30C of movable anvil portion 30A. Detent assembly 47 provides valve action and metering action to temporarily delay movement of hammer 32. Hammer 32 is thereby restrained to move at a slow rate of speed proportional to a rate of flow hydraulic fluid through metering bore 49. Thus, the initial velocity of hammer 32 towards anvil assembly 30 is limited, giving time for movable anvil portion 30A to move axially against anvil support 30B. A version of detent 47 is disclosed in U.S. Pat. No. 4,109,736, which is incorporated herein by reference. Release slots 44, shown also in FIGS. 7, allow oil to flow from top to bottom of detent assembly 47 to equalize the pressure above and below detent assembly 47, thereby bypassing the metering action through detent assembly 47 to allow for high-speed acceleration of hammer 32 to impact movable anvil portion 30A. Thus, the release slots act as an override mechanism that overrides or circumvents the metering action.

Figure 6:
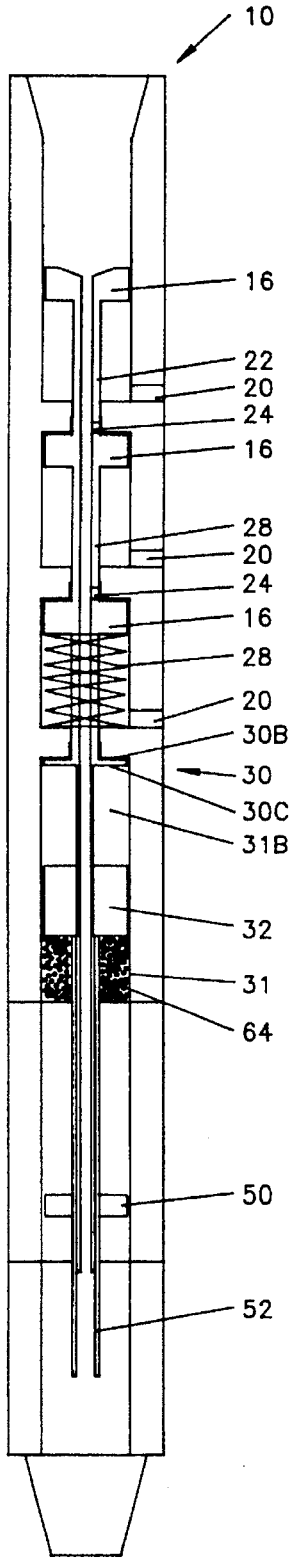
FIG. 6 is a diagrammatic view illustrating the jar apparatus of FIG. 4 when the jar hammer is cocked and actuated.
Figure 7:
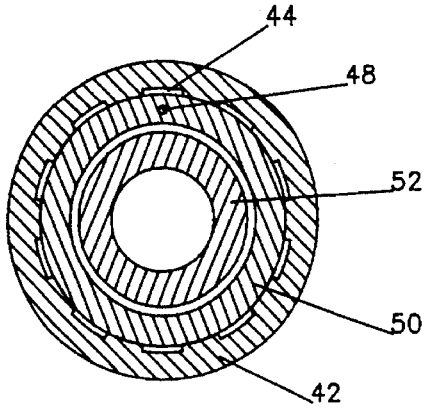
FIG. 7 is an enlarged top view, in section, with the detent assembly positioned in the release slots, of a hydraulic fluid meter having a pin and metering bore used to delay movement of the jar hammer toward an anvil member in accord with the present invention.
Figure 8:
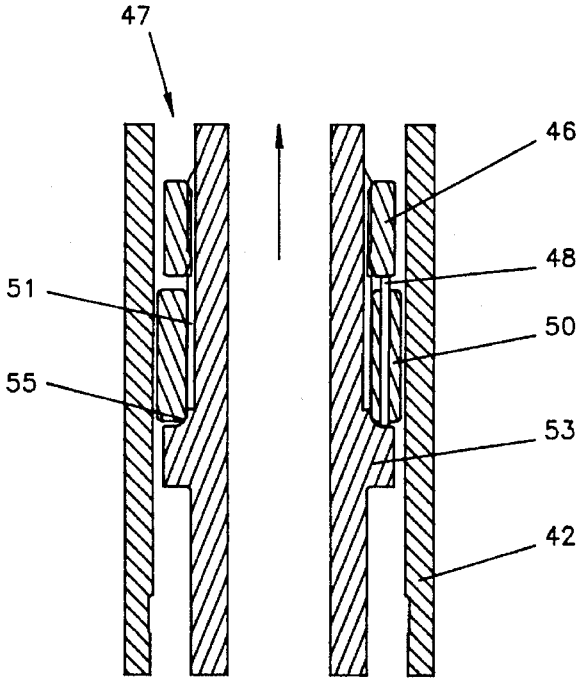
FIG. 8 is an enlarged elevational view, in section, of the hydraulic fluid meter of FIG. 7 in a closed position such that the hydraulic fluid must be metered through the metering bore.
Figure 9:
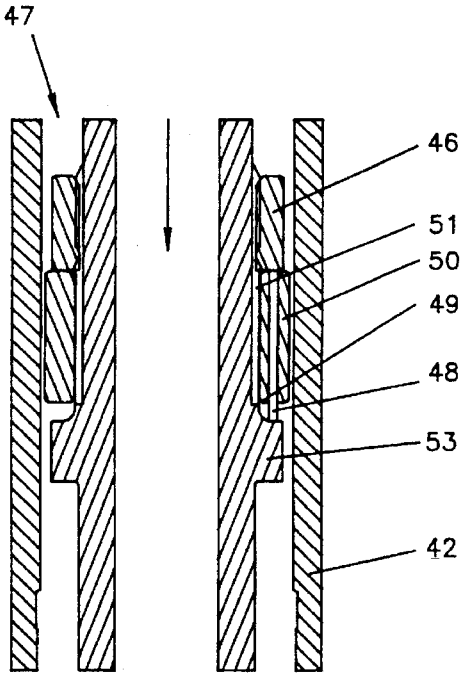
FIG. 9 is an enlarged elevational view, in section, of the hydraulic fluid meter of FIG. 8 in an open position such that hydraulic fluid may flow around the metering bore.

With reference more specifically to detent assembly 47 as shown in FIGS. 7–9, there is shown detent mandrel 52 with flange portion 53. A metering pin 48 extends through metering bore 49 to meter oil through detent assembly 47 to temporarily slow movement of hammer 32 towards movable anvil portion 30A after hammer 32 is cocked and released, as shown in FIG. 3 and FIG. 6 and as discussed hereinafter. Detent ring 50 provides a valve to open and close bypass passageway 51 that communicates around metering pin 48 and metering bore 49. Detent ring 50 moves relatively downwardly to close bypass passageway 51 at seal surface 55 on detent mandrel flange portion 53 when detent mandrel 52 moves upwardly, or in the direction of top sub 12, as indicated in FIG. 8. Detent ring 50 moves relatively upwardly to open bypass passageway 51 when mandrel 52 moves downwardly toward lower sub 62, as indicated in FIG. 9. Movement of detent ring 50 is limited by detent ring retainer 46. Thus, detent assembly 47 is movable into the cocked position without significant restraint from hydraulic fluid.

Neutralizer cylinder 54 is preferably secured to detent cylinder 42. Neutralizer piston 56 is reciprocable within neutralizer sub 54. Lower connector sub 62 is secured to neutralizer cylinder 54 and includes neutralizer port 60. Neutralizer port 60 allows hydrostatic pressure to act on neutralizer piston 56 so that oil within detent cylinder 42 is effectively maintained at the hydrostatic pressure of the wellbore surrounding jar 10. Thus, the effects of hydrostatic pressure in the wellbore are neutralized and do not affect operation of jar 10. Lower connector sub 62 defines a preferably threaded bottom connector for connecting jar 10 within the wellbore string. Jar bore 17 extends through lower sub 62 for communication through jar 10.

Thus, for operation of the present invention, it is provided that the upper section of jar 10 has multiple pistons 16 reciprocal in respective piston cylinders 14. These are differential pistons and are actuated by pressure such as from rig pump 66 shown in FIGS. 10 and 11. Pistons 16 are actuated in unison, and any number of pistons 16 may be utilized by interconnecting the desired number of piston cylinders 14. Pistons 16 provide the driving force to axially move hammer 32 to the position shown in FIGS. 5 and 6 so as to cock jar 10.

The combined weight of hammer 32 and detent mandrel 52 form a driving ram. Part of detent mandrel 52 is equipped with a valve assembly detent ring 50 that has therein a bore 49 for receiving a metering pin 48 as discussed hereinbefore. Detent ring 50 is restricted from movement too far upwardly and thereby supported in the desired range of movement by detent ring retainer 46. Directly below hammer 32 is nitrogen chamber 31 filled with nitrogen 64 at a predetermined pressure. Detent ring 50 is movable with detent cylinder 42 below nitrogen chamber 31, and detent cylinder 42 is filled with a noncompressible liquid such as oil. Detent cylinder 16 also includes a reduced internal diameter portion 45 having release grooves or slots 44 thereabove as indicated in the associated FIGS. 1–6.

Figure 4:
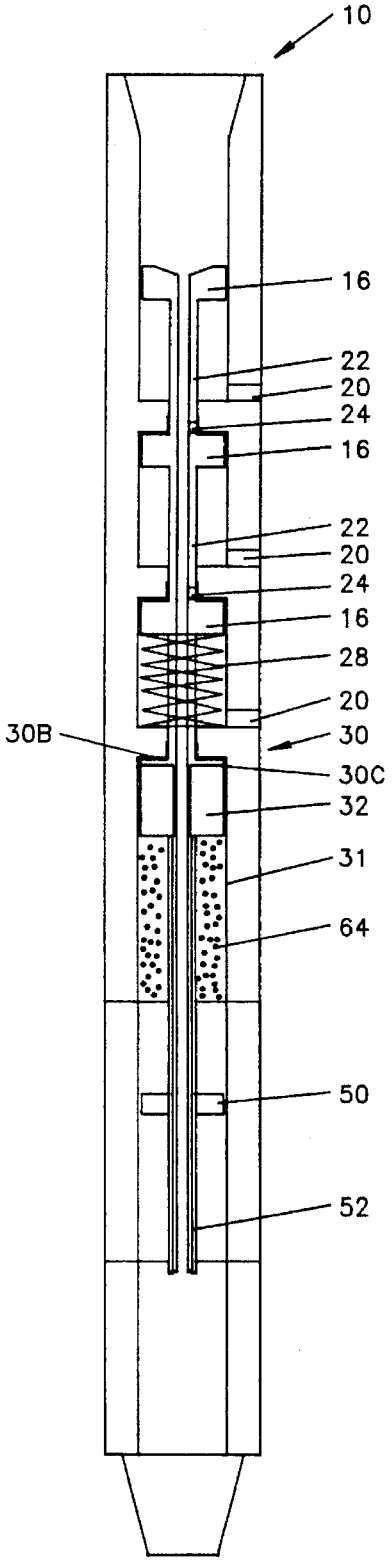
FIG. 4 is a diagrammatic view illustrating a jar apparatus in accord with the present invention in the closed position.
Figure 5:
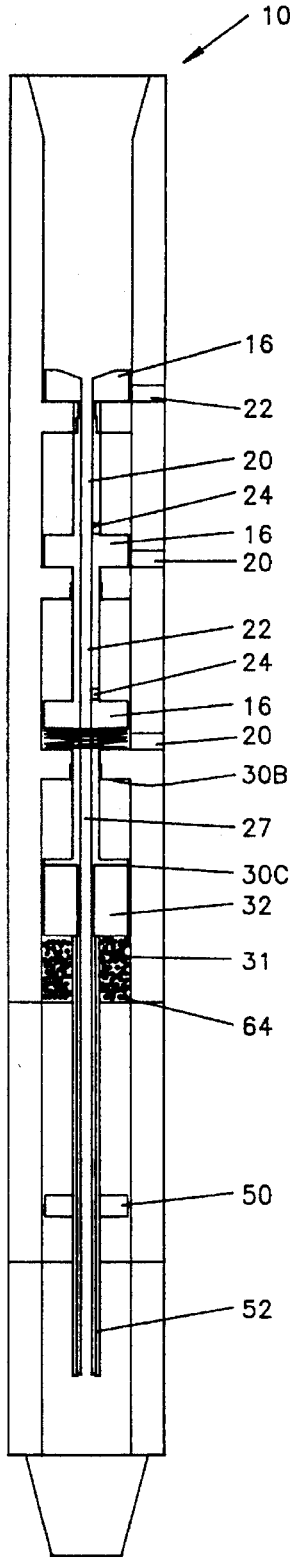
FIG. 5 is a diagrammatic view illustrating the jar apparatus of FIG. 4 with the jar hammer cocked.

The predetermined pressure of nitrogen 64 is such that under ordinary pumping operations ram jar 10 will remain in the uncocked or closed position as in FIGS. 1 and 4. The pressure of nitrogen 64 will typically increase significantly due to downhole conditions such as downhole temperature, and therefore the predetermined pressure is selected in consideration of such factors. When it is desired or necessary to actuate jar 10, the rig pump 66 pressure is increased, generally by several hundred pounds or more depending on the number of pistons 16, over the previous operating pressure. This increase in pressure from rig pump 66 is communicated to bore 13 of string 11 and jar bore 17 to actuate multiple pistons 16 and force hammer 32, along with detent mandrel 52, downward away from top sub 12. Detent ring 50 is thereby positioned in the portion of reduced diameter 45 in detent cylinder 54. Nitrogen 64 is now highly compressed below hammer 32. However, hammer 32 is held from moving rapidly upwardly by detent ring 50. Thus, hammer 32 is thereby placed in the cocked position as shown in FIG. 2 and FIG. 3.

The rig pump 66 pressure at the surface is released by some means such as reducing pump pressure or valve action or the like to reduce pressure within pipe string bore 13 and jar bore 17. With reduced or no differential pressure on pistons 16, compression spring 28 forces pistons 16 upwardly toward top sub 12 and thereby moves movable anvil portion 30A out of contact with the top of hammer 32 and against fixed anvil member support portion 30B. Void or vacuum 31B is created between hammer 32 and anvil assembly 30 (see FIGS. 3 and 6)

Compressed nitrogen 64 (and the void or vacuum 31B) continues to force hammer 32 upwardly toward movable anvil portion 30A and fixed anvil support portion 30B. The noncompressible fluid is metered around metering pin 48 to prevent sudden acceleration of hammer 32. Hammer 32 and detent mandrel 52 move slowly upwardly in the direction of top sub 12 until detent ring 50 clears release slots 44. Once release slots 44 are cleared, a flow path for the hydraulic fluid exists whereby hydraulic fluid is no longer forced around metering pin 48. At that moment, hammer 32 and detent mandrel 52 begin to accelerate rapidly upwardly causing the top of hammer 32 to impact striking surface 30C of movable anvil portion 30A.

In FIG. 3 and FIG. 6, hammer 32 is shown in the cocked position just after rig pump pressure or pipe string pressure is reduced, to thereby cause movable anvil portion 30A to move away from hammer 32 due to bias from compression spring 28. As discussed, hammer 32 moves slowly after being released until detent ring 50 clears release grooves or slots 44, whereupon hammer 32 accelerates and impacts striking surface 30C.

After the axially directed jar impact, hammer 32 will be in the closed position shown in FIGS. 1 and 4. Thus, jar 10 is normally closed such that hammer 32, movable anvil member 30A, and anvil support portion 30B are in contact. From this position, ordinary pumping pressure may be continued, or increased by approximately several hundred pounds to cock jar 10 and continue jarring by releasing pump pressure as described. Thus, the jarring action occurs without the need to reciprocate (or rotate) the string in the wellbore. This is particularly important in cases where the wellbore string is coiled tubing wherein repeated reciprocation of the coiled tubing induces stresses that can cause failure of the coiled tubing.

The procedure of operating the rig pump system or any other system to increase and decrease pipe string 11 and jar bore 17 pressure may be continued as long as desired to release a stuck BHA or for other purposes.

FIGS. 10 and 11 schematically indicate a typical environment in which jar 10 may be used. In FIG. 10, coiled tubing spool 68 is used to run coiled tubing 11 into borehole 19. Rig pump 66 provides pressure in bore 13 of coiled tubing 11 via hose connection 70. Lubricator 72 provides pressure control for wellbore 19. By using the jar 10 described hereinbefore, it is possible to provide that the length of jar 10, and related attachments thereto, is less than the axial length of lubricator 72. However, the design does not require that jar 10 be of a relatively short length where there is no need to have a restricted length. Jar 10 may be secured to pipe/coiled tubing either above or within the bottom hole assembly (BHA) that includes pipe collars 74, MWD tool 76, mud motor 78, and bit 80. FIG. 10 also illustrates the region 82 of bending stress of coiled tubing 11. By eliminating the need to move string 11, the repetitive stress of jarring is prevented by the method of the present invention. Item 80 might also represent a grapple so that coiled tubing may sometimes be used to grapple a downhole fish or assembly in cases where other fishing techniques may not be possible. Jar 10 may advantageously be used for this purpose so that sting 11 may be tightened and repeated jarring applied to the fish without reciprocating string 11.

FIG. 11 schematically indicates drilling rig 84 with pump 66 and hose connection 70 for pumping into string 11. In this case, wellbore string 11 is of conventional pipe operated by a drilling or workover rig, such as rig 84; i.e., it is not a coiled tubing unit. Rig 84 may be used to reciprocate pipe string 11 with traveling blocks 86 if desired. Pipe string 11 and the BHA include separate or non-continuous drill pipes 94, double acting reciprocating jar 96, separate heavy weight drill pipes 88, drill collars 98, ram jar 10, ram jar 10B, disconnect sub 92, ram jar 10B, ram jar 10C, drill collars 100 that may be nonmagnetic, MWD tool 102, mud motor 104, and bit 106. It will be noted that this BHA is provided for illustrative purposes only to provide understanding of the great flexibility of operation and advantages of the present invention. Those skilled in the an will understand that many various BHA assemblies may be designed that will depend on the drilling conditions and the desired purposes therefore.

With prior art jars, if the jar is located below the stuck point, such as stuck point 90, then that jar could not be activated by reciprocating pipe string 11. However, a single jar 10B and/or one or more additional jars, such as jar 10C of the present invention, may be activated in this same situation since activation does not depend on pipe string manipulation (i.e. reciprocating the string 11).

One advantage of the present invention is that jars in accord with the present invention, such as jar 10-jar 10C shown for illustration, may be used in combination to produce multiple sequential impacts. Sequential timing for use of jar 10 may be provided, if desired, by varying metering bore 48 and/or metering pin 49 in the different jars so that the jars produce an impact at sequential times. As well, for this purpose, fluids having different viscosities but using the same metering mechanisms could also be used. Although it has been attempted in the past to develop multiple sequential impact jarring tools, such prior art tools have not been successfully operational. The present invention allows for this type of jarring, if desired.

For instance, jar 10 and one or more jars such as jar 10A may each be oriented to produce sequential multiple up-jar impacts or sequential multiple down-jar impacts. If key seating has been a problem in a particular field, the orientation of the two or more jars such as jar 10 and jar 10A may be downwardly because downward jarring is more effective in that situation.

Alternatively, in some cases depending on drilling conditions, it may be desirable to produce sequential up-jar and then down-jar impacts. Thus, two or more jars such as jar 10B and jar 10C could even be oriented in opposite directions to produce this effect. In the illustrated scenario, jars 10B and 10C are located below stuck point 90 which location may possibly be anticipated by past drilling history in a particular field.

It will also be noted that double acting reciprocating jar 88 may be operated independently of the jars 10–10C by reciprocating pipe string 11. Thus, the present invention provides flexibility of jarring operation that has not been available in the past as well as other significant advantages discussed hereinbefore.

Because bore 17 through jar 10 is smooth and may be designed for a desired diameter, then a ball may be dropped through jar 10 to operate hydraulic disconnect sub 92 for releasing the remainder of the BHA, as may be desired. Fishing operations could then continue in the manner well known to those skilled in the art. It will be noted that various wireline fishing tools may be pumped or dropped through bore 17 in jar 10.

A drop ball or member is used herein to refer to a ball, bar, rod, key, elastomeric, logging tool, free point tool, back-off device, or other item that may be dropped or pumped through bore 17 of jar 10. The ball, bar, or other dropped member may be dropped through the smooth bore 17 of jar 10 without becoming stuck therein due to the smooth walls of bore 17. Bore 17 may be designed to be large enough to allow passage of the drop ball. Most drop balls will typically be less than about 2 inches in diameter. Wireline tools that are sometimes lowered through a stuck downhole assembly may typically range from about ⅞ inch in diameter to about 3 ⅞ inches in diameter. However, the present jar design allows adaptation of bore 17 to be of a selected diameter that may include or be of larger or smaller diameters than these values as desired.

Although jars 10–10C are shown in a particular position in pipe string 11, there are many options and positions in which one or more jars in accord with the present invention may be used. As well, while the present invention is directed to a jar that may be actuated without reciprocating the pipe string, the present invention could be modified to include components movable with the drill string to enhance or assist the jar mechanism of the present invention. See, for instance, the jar mechanism energizer of U.S. Pat. No. 4,545,444 that is incorporated herein by reference. Thus, the tubular housing of jar 10, comprised of the various interconnected tubular components (subs) discussed hereinbefore, could conceivably have a telescoping portion or movable portion. As well, other means could be used to temporarily restrain movement of the hammer other than the oil metering detent assembly with bypass valve and release grooves as disclosed hereinbefore. Thus, the utility of the present invention is not limited to the presently preferred embodiment of the best mode of the invention that is disclosed herein in accordance with the patent laws.

The foregoing disclosure and description of the invention is purely illustrative and explanatory thereof, and it will appreciated by those skilled in the art that various changes in the size, shape, and materials, as well as in the details of the illustrated construction or combinations of features of the various coring elements, may be made without departing from the spirit of the invention.

What is claimed is:

1. A jar apparatus for use within a borehole, comprising:

a tubular housing having first and second opposing connection ends;

a fluid inlet at said first connection end defining a fluid entrance into said jar apparatus;

an anvil member disposed in said tubular housing;

a hammer member disposed for axial movement in said tubular housing, said hammer member being axially movable within said tubular housing between a first closed position with said hammer member proximal said anvil member and a second position such that said hammer member is axially from said first closed position;

a first biasing means disposed in said tubular housing and operable for biasing said hemmer member axially in the direction of said first closed position; and a pressure-responsive control assembly disposed in said tubular member and responsive to a first fluid pressure at said fluid inlet for urging said hammer member axially from said first closed position to said second position, said pressure-responsive control assembly being responsive only to a second different fluid pressure at said fluid inlet for releasing said hammer member from said second position for movement toward said anvil member and said first closed position.

2. The jar apparatus of claim 1, wherein:

said tubular housing defines an unobstructed bore extending through the length of said jar apparatus for communicating said fluid pressure through said jar apparatus.

3. The jar apparatus of claim 1, wherein said anvil member includes:

an anvil support portion to secure said anvil member with respect to said tubular housing, and a movable anvil portion separable from said anvil support portion and axially movable in conjunction with said hammer member to a position distal said anvil support portion.

4. The jar apparatus of claim 3, wherein:

said pressure-responsive control assembly is responsive to said second lower fluid pressure to move said movable anvil portion axially away from said hammer in the direction of said anvil support portion.

5. The jar apparatus of claim 1, further comprising:

said tubular housing defining therein a fluid passageway with a single continuous wall extending axially through said anvil, said hammer, and said pressure-responsive control system.

6. The jar apparatus of claim 5, wherein said first and second connection ends are operable for securing said jar apparatus within said borehole for producing a downwardly directed jar impace, and are alternatively operable for securing said jar apparatus within said borehole for producing an upwardly directed jar impact by reversing the positions of said first and second connections.

7. The jar apparatus of claim 1, wherein said first fluid pressure is greater than said second fluid pressure and second fluid pressure is sufficient to circulate fluid through said jar apparatus and said borehole.

8. The jar apparatus of claim 1, wherein said pressure-responsive control system is operable to hold said hammer member substantially stationary at said second position while said first fluid pressure is maintained at said fluid inlet.

9. The jar apparatus of claim 1, further comprising:

a restraining assembly operable for temporarily restraining movement of said hammer member toward said anvil member.

10. The jar apparatus of claim 9, wherein said restraining assembly further comprises:

a restraining piston axially movable in a restraining chamber defined within said tubular housing and having a restricted portion, said restraining chamber containing therein a noncompressible fluid.

11. The jar apparatus of claim 10, wherein:

said restraining piston includes fluid metering means operable when said restraining piston is within said restricted portion for restraining relative axial movement of said hammer member toward said anvil member, said restraining assembly permitting movement of said hammer member toward said anvil member at a rate of speed proportional to a rate of flow of said noncompressible fluid through said fluid metering means.

12. The jar apparatus of claim 11, further comprising:

a valve operable for controlling a bypass of said metering orifice, said valve being operable to open said bypass as said hammer member moves from said first closed position toward said second position, said valve being operable to close said bypass as said hammer member moves toward said anvil member.

13. The jar apparatus of claim 9, further comprising:

override means operable for overriding said restraining assembly to allow high acceleration of said hammer member toward said anvil member.

14. The jar apparatus of claim 13, wherein said override means include a release groove in a restraining chamber operable to equalize pressure in front of and behind said restraining piston to allow said restraining piston to move without substantial resistance.

15. The jar apparatus of claim 1, wherein said pressure-responsive control assembly further comprises:

a plurality of control pistons axially movable in response to said first fluid pressure.

16. The jar apparatus of claim 1, further comprising:

a plurality of control pistons each movable within a respective control cylinder, each respective control cylinder defining a port in communication with a wellbore portion surrounding said jar apparatus, said tubular body defining a jar bore through said jar apparatus, said plurality of control pistons being axially movable in response to a pressure differential between a pressure in said jar bore and a pressure in said wellbore portion surrounding said jar apparatus.

17. The jar apparatus of claim 16, wherein:

said anvil member includes a movable anvil portion secured to said plurality of pistons that is axially movable with said plurality of pistons.

18. The jar apparatus of claim 17, further comprising:

a second biasing element, said second biasing element being operable for biasing said plurality of pistons in a direction axially away from said hammer member.

19. The jar apparatus of claim 1, further comprising:

said anvil member having a movable portion; and a second biasing element disposed in said tubular housing having one end secured against axial movement therein, said second biasing element being operable to bias said movable portion of said anvil member in an axial direction away from said hammer member.

20. The jar apparatus of claim 1, wherein said first biasing assembly further comprises:

a pressurized gas chamber.

21. The jar apparatus of claim 1, wherein said tubular body includes a jar bore therethrough having a smooth surface to allow passage of a drop ball.

22. A system for providing a first jar impact within a wellbore string that incorporates a first jar apparatus, said system comprising:

a wellbore pressuring means operable for producing first and second fluid pressures within a bore internal to said wellbore string;

an anvil member within said first jar apparatus being operable for transmitting to said wellbore string said first jar impact;

a hammer member within said first jar apparatus being axially movable between a first closed position adjacent said anvil member and a second cocked position axially spaced from said anvil member, said hammer member being operable for impacting said anvil member to deliver said first jar impact;

a first biasing assembly within said first jar apparatus being operable for biasing said hammer member axially in the direction of said anvil member;

at least one control piston within said first jar apparatus axially movable in response to said first fluid pressure for moving said hammer member toward said second cocked position, said at least one control piston being axially movable in response to said second fluid pressure to release said hammer member from said second cocked position for movement toward said anvil responsive to said first bias assembly, said anvil member and said hammer member and said at least one control piston defining a substantially straight, unobstructed bore extending completely through the first jar apparatus and in fluid communication with said wellbore pressuring means.

23. The system of claim 22, further comprising:

a lubricator for sealing said wellbore string, said lubricator being operable for controlling wellbore pressure, said lubricator having an axial length greater than an axial length of said first jar apparatus.

24. The system of claim 22, further comprising:

a first restraining assembly within said first jar apparatus operable for temporarily restricting movement said hammer member toward said anvil member.

25. The system of claim 22, wherein: said wellbore pressuring means is operable to produce a third fluid pressure for circulating fluid through said wellbore string, said first fluid pressure being greater than said third fluid pressure, said first biasing assembly preventing movement of said hammer in response to said third fluid pressure.

26. The system of claim 22, further comprising:

a coiled tubing unit to provide said wellbore string.

27. The system of claim 22, further comprising:

a hydraulic disconnect incorporated within said wellbore string below said first jar apparatus, said hydraulic disconnect being operable in response to a drop member that passes through said first jar apparatus.

28. The system of claim 22, further comprising at least one more jar apparatus operable in response to said first and second fluid pressures to produce at least one more sequential jar impact, said first and second fluid pressures being unequal.

29. The system of claim 28, wherein:

said at least one more jar apparatus is oriented to produce said at least one more sequential jar impact directed in substantially the same direction as said first jar impact.

30. The system of claim 28, wherein:

said at least one more jar apparatus is oriented to produce said at least one more sequential jar impact directed in a substantially opposite direction from said first jar impact.

31. The system of claim 28, further comprising:

a first restraining assembly within said first jar apparatus operable for restricting movement of said hammer member toward said anvil member for a first time period, at least one more restraining assembly for said at least one more jar apparatus operable for restricting movement of said hammer member toward said anvil member for at least one more time period different from said first time period to thereby produce at least one more sequential jar impact.

32. The system of claim 22, further comprising:

a second jar apparatus independently operable from said first jar apparatus in response to movement of said wellbore string.

33. A method for delivering a jar impact to a component of a wellbore string, said wellbore string including therein a jar apparatus comprising a hammer member and an anvil portion for producing said jar impact, said wellbore string having an internal bore, said method comprising the following steps:

running said wellbore string into a wellbore;

cocking said hammer member by creating a first pressure within said internal bore for moving a plurality of pistons axially with respect to said wellbore string to thereby move said hammer member to a cocked position; and releasing said hammer member from said cocked position by creating a second pressure to thereby allow said hammer member to move substantially axially toward and strike said anvil portion to deliver said jar impact.

34. The method of claim 33, further comprising:

providing a substantially constant size, unobstructed jar apparatus bore through said jar apparatus extending from a first end of said jar apparatus to a second end of said jar apparatus, said jar apparatus bore being in communication with said internal bore.

35. The method of claim 34, wherein said step of cocking said hammer member further comprises:

producing said first pressure as a first differential pressure between said jar apparatus bore and said borehole surrounding said jar apparatus, and producing said second pressure as a second differential pressure between said jar apparatus bore and said borehole surrounding said jar apparatus, said first pressure being unequal to second pressure.

36. The method of claim 34, further comprising:

providing communication through said jar apparatus bore from said first end of said jar apparatus to said second end of said jar apparatus.

37. The method of claim 33, further comprising: passing a drop ball through said jar apparatus.

38. The method of claim 33, wherein said step of cocking said hammer member further comprises:

moving a movable element of said anvil portion in conjunction with said hammer member.

39. The method of claim 38, wherein said step of releasing said hammer member further comprises:

moving said movable element of said anvil portion axially apart from said hammer member.

40. The method of claim 39, further comprising:

limiting initial velocity of said hammer member toward said anvil portion with a noncompressible liquid until after said step of moving said movable element of said anvil portion axially apart from said hammer member.

41. The method of claim 40, further comprising:

metering said noncompressible liquid through a metering hole.

42. The method of claim 33, further comprising:

biasing said hammer member in the axial direction of said anvil portion.

43. The method of claim 33, further comprising:

biasing said plurality of pistons in a direction away from said hammer member.

44. The method of claim 33, further comprising:

selectively orienting said jar apparatus in said wellbore string to provide either an upwardly directed jar impact or a downwardly directed jar impact with respect to said wellbore string.

45. The method of claim 33, further comprising: limiting initial velocity of said hammer member toward said anvil portion after said step of releasing said hammer member.

46. The method of claim 33, further comprising:

performing said steps of cocking and releasing without reciprocating said wellbore string.

47. The method of claim 33, further comprising:

adding an additional piston/cylinder assembly to said jar apparatus to produce a desired axial force for cocking said jar apparatus.

48. The method of claim 33, further comprising:

supplying said at least a portion of said wellbore string with a coiled tubing unit, pulling on a stuck downhole assembly with said coiled tubing unit, and jarring said stuck downhole assembly without reciprocating said wellbore string.

* * * * *

UNITED STATES PATENT AND TRADEMARK OFFICE

CERTIFICATE OF CORRECTION

PATENT NO. : 5,503,228
DATED : April 2, 1996
INVENTOR(S) : Edwin A. Anderson

It is certified that error appears in the above-indentified patent and that said Letters Patent is hereby corrected as shown below:

Col. 4, line 10, change "and" to --used--.
Col. 9, line 54, change "sting" to --string--.
Col. 11, line 44, insert --spaced-- between "axially" and "from";
11, line 47, change "hemmer" to --hammer--.
Col. 13, line 8, change "body" to --housing--;
13, line 33, change "body" to --housing--.
Col. 14, line 7, insert --of-- between "movement" and "said";
14, line 14, insert --member-- between "hammer" and "in".
Fig. 1, change item "30" in the lower left hand corner next to item "26" to item "23".
Fig. 3, change item "30" in the lower left hand corner next to item "26 to item "23".

Signed and Sealed this

Fifteenth Day of October, 1996

*Attest:*

Bruce Lehman

BRUCE LEHMAN

*Attesting Officer*

*Commissioner of Patents and Trademarks*